United States Patent [19]

Have

[11] 4,359,006

[45] Nov. 16, 1982

[54] METHOD OF EXTRACTING HEAT FROM MANURE SEWAGE MUD AND OTHER WET WASTE BY COMBUSTION

[76] Inventor: Henrik Have, 27, Kong Valdemarsvej, DK-4000 Roskilde, Denmark

[21] Appl. No.: 224,564

[22] PCT Filed: Mar. 24, 1980

[86] PCT No.: PCT/DK80/00019

§ 371 Date: Nov. 17, 1980

§ 102(e) Date: Nov. 17, 1980

[87] PCT Pub. No.: WO80/02062

PCT Pub. Date: Oct. 2, 1980

[30] Foreign Application Priority Data

Mar. 26, 1979 [DK] Denmark ..... 1217/79

[51] Int. Cl.[3] ..... F23G 5/04

[52] U.S. Cl. ..... 110/346; 110/224; 110/238

[58] Field of Search ..... 110/238, 224, 227, 346

[56] References Cited

U.S. PATENT DOCUMENTS

| | | | |
|---|---|---|---|
| 2,032,402 | 3/1936 | Colby et al. | 110/224 X |
| 2,066,418 | 1/1937 | O'Mara | 110/224 X |
| 3,734,036 | 5/1973 | Abos | 110/346 |
| 4,213,407 | 7/1980 | Headley | 110/238 X |
| 4,245,570 | 1/1981 | Williams | 110/238 |

FOREIGN PATENT DOCUMENTS

| | | | |
|---|---|---|---|
| 55-146316 | 11/1980 | Japan | 110/238 |

*Primary Examiner*—Edward G. Favors

*Attorney, Agent, or Firm*—Oblon, Fisher, Spivak, McClelland & Maier

[57] ABSTRACT

Wet waste (1) is dried in a drier (3) by a blowing through of the flue gas (7) from the combustion of already dried waste and an appropriately amount of auxiliary air, and the heat from the combustion is generated by means of a scrubber (10) also cleaning the air for fume and dust particles, as well as certain nitrogen and sulphur and unpleasantly smelling compounds. Subsequently, the wash water releases the heat to a heat consumer through a heat exchanger (12), and impurities are precipitated in the clearing tank (15), while condensed water from the waste is carried away through a vent pipe (14).

8 Claims, 2 Drawing Figures

METHOD OF EXTRACTING HEAT FROM MANURE SEWAGE MUD AND OTHER WET WASTE BY COMBUSTION

BACKGROUND OF THE INVENTION

1. Field of the Invention

The present invention relates to a method of extracting heat from manure, sewage mud, and other wet waste by combustion, the method comprising using a combined drying-, combustion-, and steam-condensing-process.

2. Description of the Prior Art

Organic waste such as for instance manure and sewage mud occurs in large quantities and often causes problems as a consequence of the content of vira, unpleasant smelling substances or dangerous toxicants. This implies that spreading of the organic waste in fields has been prohibited or connected with the risk of infection and inconveniences for the surroundings.

The wet waste contains a considerable amount of energy, which as for the manure alone corresponds to about a quarter of the energy annually consumed for heating in Denmark.

The extraction of heat from this waste is, however, difficult due to the high content of water, which implies that a direct combustion is impossible. Instead of combustion, biological methods for converting the substances may be employed, anaerobic conditions permitting generation of gas and aerobic conditions permitting generation of heat. These methods, however, require rather expensive plants, and in practice maximum about 30% of the total energy of the waste can be extracted.

By mixing sewage mud and household waste in an appropriate ratio, it is possible to combust the mud. However, the major part of the energy of the dry matter is used for evaporating the water and is thereby lost through the chimney.

SUMMARY OF THE INVENTION

The method according to the invention for extracting heat from manure and other wet waste by combustion is characterised in that the waste is dried prior to the combustion and the drying is performed by means of heat from the combustion of already dried waste, the entire amount of flue gas from the combustion, which is mixed with auxiliary air to obtain an appropriately low temperature of the drying air, being blown through the wet waste in the drier in such a manner that the water content is reduced. Furthermore, the method is characterised in that the flue gas mixed with auxiliary air after having passed through the drier is carried through a scrubber, i.e. an apparatus in principle constructed as a cooling tower. In this tower the air is cooled during the condensation of steam at the same time as the wash water is heated. Moreover, the method may have the special feature that the wash water releases the heat in a heat exchanger connected to a heat consumer. Having passed the heat exchanger, the wash water is carried to a clearing tank, in which impurities are precipitated before the wash water is recirculated to the scrubber by means of a pump.

By this method, waste having a water content of up to about 80% may be combusted at the same time as 50 to 70% of the energy contained in said waste is extracted as heat at a temperature sufficiently high for direct use for space heating. The method furthermore ensures that dust and fumes are intercepted by the water in the scrubber. Furthermore, the wash water intercepts part of the nitrogen and sulphur compounds as well as smelling substances deriving from the combustion and the drying. As a result the discharge air is cooled and cleaned in such a manner that a chimney in most cases is unnecessary.

The most simple method according to the invention is preferably a continuous drying-, combustion-, and steam-condensing-process, which can utilize the energy in waste containing up to about 80% of water, and which operates with a moderate efficiency.

The efficiency may, however, be essentially improved by recirculating part of the discharge air and use it as auxiliary air, whereby the loss of energy in the discharge air is reduced.

In preparation of combustion of still wetter waste containing up to about 85% of water, energy may furthermore be recirculated to the drier by preheating the auxiliary air and optionally also the combustion air by passing said air through an air heater receiving hot water from the heat exchanger.

As the method operates with dry air temperatures of the same magnitude or higher than the ignition temperature of the waste, the risk of ignition in the drier exists if dry portions occur in the waste. Under such conditions, it may therefore be an advantage to mount a device increasing the amount of auxiliary air and thereby reduce the dry air temperature when the temperature of the air on the discharge side of the drier exceeds a predetermined level.

The control of the method is performed by adjusting the amount of combustion air according to the difference temperature on the discharge side of the heat exchanger in such a manner that a declining heat consumption involving an increasing difference in temperature implies a reduction of the amount of combustion air.

In order to ensure a desired temperature on the supply-pipe to the hot-water radiators, the amount of water to the scrubber is adjusted according to the water temperature in the discharge pipe of the scrubber.

BRIEF DESCRIPTION OF DRAWINGS

The invention will be described below with reference to the accompanying drawing, in which.

BEST MODE FOR CARRYING OUT THE INVENTION

Figure 1:
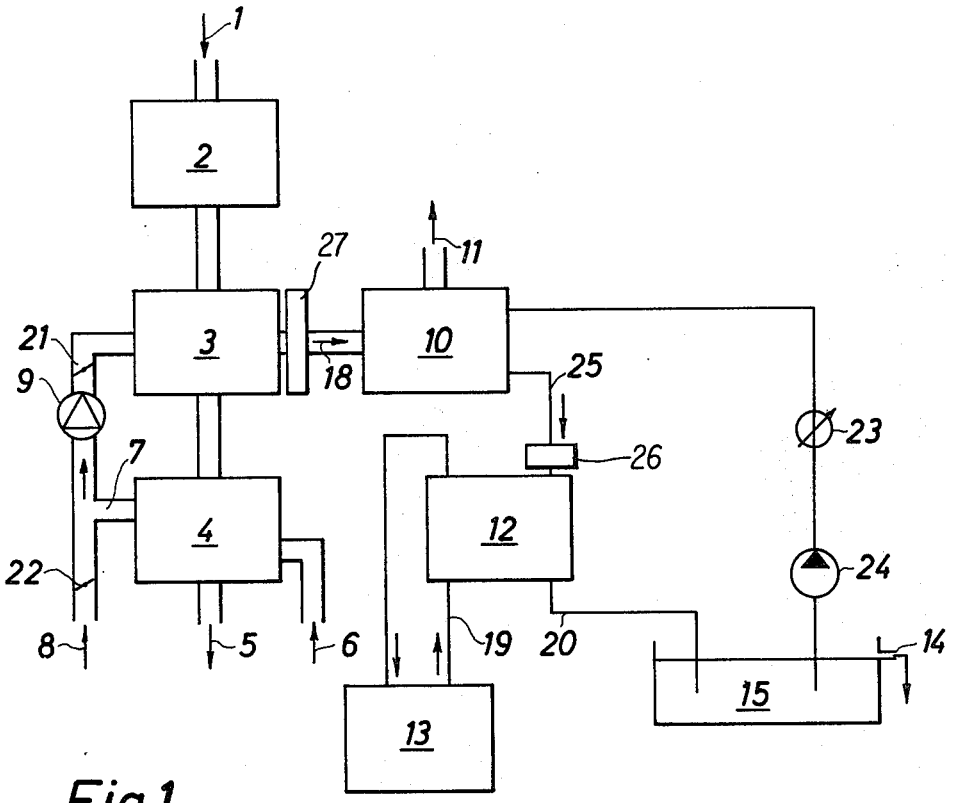
FIG. 1 is a diagrammatic view of a system for carrying out the method according to the invention applicable at a water content of up to about 80%.

According to the simple method illustrated in FIG. 1, the wet waste 1 is carried to a dosage and structuring mechanism 2, which may comprise a worm conveyor or the like pressing the waste through a matrix, or comprise a system of rollers dividing the waste into fine particles. From this dosage mechanism the material is introduced into the drier 3 and dried, whereupon it is carried on to a combustion furnace 4. In this combustion furnace the combustion to ashes 5 is performed by supplying fresh air 6, whilst the flue gas 7 mixed with auxiliary air 8 by means of a blower 9 is carried to the drier 3 and subsequently as partially cooled humid air 18 on to a scrubber 10. In the scrubber constructed according to the same principle as a cooling tower, the air passes a large water surface and is carried to the atmosphere as discharge air 11.

The wash water heated in the scrubber is carried to a heat exchanger 12 connected to a heat consumer 13, whereafter the wash water is carried on to a clearing tank 15 provided with vent pipes 14. In this tank, the water is cleared before it by means of a pump 24 is returned to the scrubber.

The generation of heat is controlled by means of a throttle valve 21 or directly by means of the ventilator 9, and adjusted according to the difference in temperature between the return water 19 from the heat consumer and the wash water 20 flowing out of the heat exchanger 12. A constant supply-pipe temperature at the heat exchanger 12 is ensured by means of a valve 23 controlled by a sensor 26 in the wash water pipe at the outlet of the scrubber 10. Finally, the dry air temperature is, if necessary, controlled by adjusting 22 the amount of auxiliary air on the basis of the temperature of the air 18 at the outlet of the drier.

Figure 2:
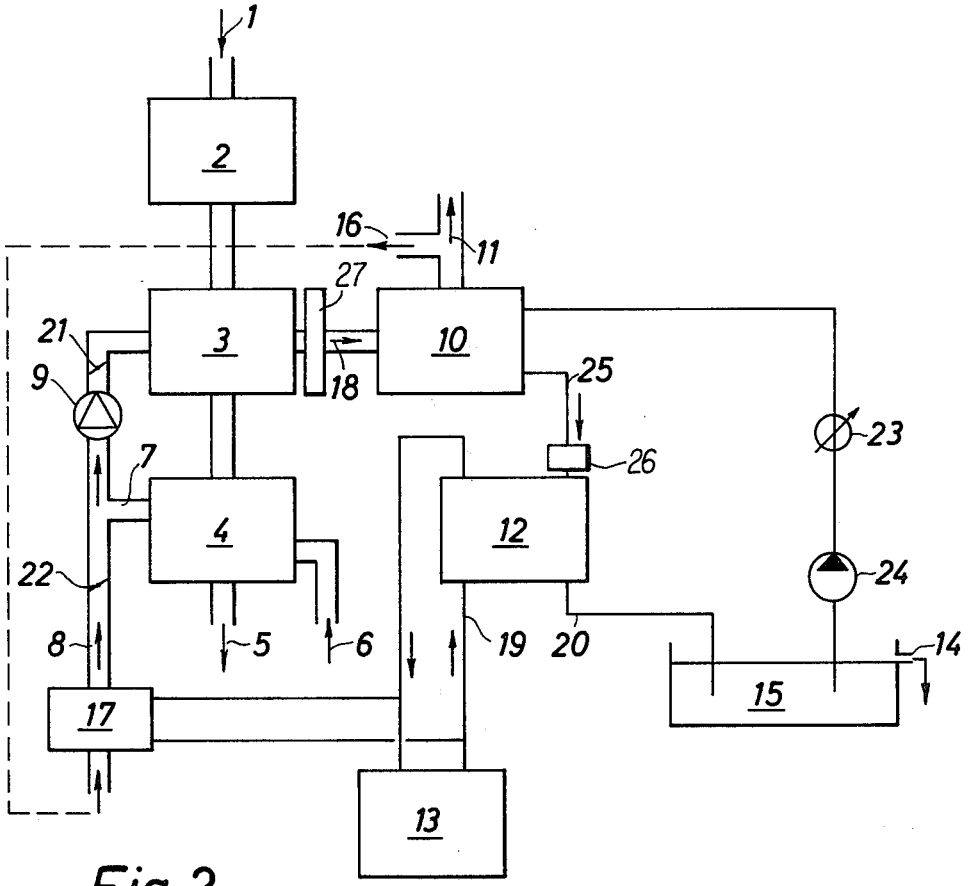
FIG. 2 is a diagrammatic view of a second system for carrying out the method according to the invention, in which part of the discharge air is recirculated to the intake of auxiliary air and is preheated by heat from the heat exchanger in such a manner that the efficiency is improved and waste containing a water content of up to 85% may be combusted.

FIG. 2 illustrates a method whereby part of the discharge air 16 is recirculated and used as auxiliary air 8 at the same time as it is preheated by passing through an air heater 17 connected to the supply side of the heat exchanger.

FIG. 2 illustrates both the recirculation of discharge air and the preheating of auxiliary air. Nothing, however, prevents a recirculation only without preheating or a preheating without recirculation. The method may furthermore be used for simple destruction of wet waste, whereby it is only omitted to extract heat from the heat exchanger.

I claim:

1. A method of extracting heat from manure, sewage mud, and other wet waste by combustion, said method comprising a combined drying-, combustion-, and steam-condensing-process, characterised in that up to the entire amount (7) of flue gas from the combustion of already dried waste is mixed with cold auxiliary air (8) to an appropriately low temperature and pressed through the wet waste in the drier (3) and on to a scrubber (10), wherein the wash water absorbs the heat and transfers it to the site of use, through a heat exchanger (12).

2. A method as claimed in claim 1, characterised in that part (16) of the discharge air (11) of the scrubber (10) is recirculated and used as auxiliary air (8).

3. A method as claimed in claims 1 or 2, characterised in that the auxiliary air (8) is preheated by passing through an air heater (17) connected as a heat consumer.

4. A method as claimed in claim 1, or 2, characterised in that the amount (8) of auxiliary air and consequently the temperature of the drying air are controlled (22) according to the temperature of the air (18) having just passed the drier (3).

5. A method as claimed in claim 1, or 2, characterised in that the generation of heat is controlled by adapting the flow (6) of combustion air to the difference in temperature between the return water (19) from the heat consumer (13) and the cooled wash water (20) from the heat exchanger.

6. A method as claimed in claim 1, or 2, characterised in that the flow of wash water through the scrubber (10) and the heat exchanger (12) is controlled according to the temperature of the wash water (25) having just left the scrubber (10) in such a manner that the supply-pipe temperature at the heat exchanger (12) is maintained constant.

7. A method as claimed in claim 1, characterized in that part (16) of the discharged air (11) of the scrubber (10) is recirculated and used as combustion air (6).

8. A method as claimed in claim 7 characterized in that the combustion air (6) is preheated by passing through an air heater (17) connected as a heat consumer.

* * * * *